United States Patent [19]

Billner

[11] Patent Number: 4,727,716

[45] Date of Patent: Mar. 1, 1988

[54] DUAL NIP OPEN-END FRICTION SPINNING

[75] Inventor: Werner Billner, Ingolstadt, Fed. Rep. of Germany

[73] Assignee: Schubert & Salzer, Ingolstadt, Fed. Rep. of Germany

[21] Appl. No.: 882,241

[22] Filed: Jul. 7, 1986

[30] Foreign Application Priority Data

Jul. 12, 1985 [DE] Fed. Rep. of Germany ..... 3524942

[51] Int. Cl.[4] ..... D01H 1/135

[52] U.S. Cl. ..... 57/401; 57/408

[58] Field of Search ..... 57/400, 401, 408, 409, 57/411, 415

[56] References Cited

U.S. PATENT DOCUMENTS

| | | | |
|---|---|---|---|
| 3,913,310 | 10/1975 | Fehrer | 57/156 |
| 4,060,966 | 12/1977 | Konig | 57/401 |
| 4,202,163 | 5/1980 | Turk et al. | 57/401 |
| 4,281,507 | 8/1981 | Didek et al. | 57/401 |
| 4,327,545 | 5/1982 | Fehrer | 57/401 X |
| 4,358,923 | 11/1982 | Feldstein | 57/401 |
| 4,404,792 | 9/1983 | Parker | 57/401 |
| 4,537,022 | 8/1985 | Stahlecker | 57/401 |
| 4,557,105 | 12/1985 | Brockmanns et al. | 57/401 |
| 4,571,932 | 2/1986 | Stahlecker et al. | 57/401 |
| 4,625,505 | 12/1986 | Raasch et al. | 57/401 |

FOREIGN PATENT DOCUMENTS 3300636 11/1983 Fed. Rep. of Germany .

*Primary Examiner*—Donald Watkins

*Attorney, Agent, or Firm*—Dority & Manning

[57] ABSTRACT

To improve integration of fibers into a yarn end and thereby improve yarn quality, fibers are directed to a feeding nip defined on an opposite side of a pair of friction rollers forming a spinning nip. The fibers are directed out of the feeding nip, passed between the friction rollers, and forwarded into the spinning nip. One of the friction rollers may constitute a conveying roller which exerts greater force upon the fibers than the other roller to securely convey fibers through a gap between the rollers and into the spinning nip.

47 Claims, 11 Drawing Figures

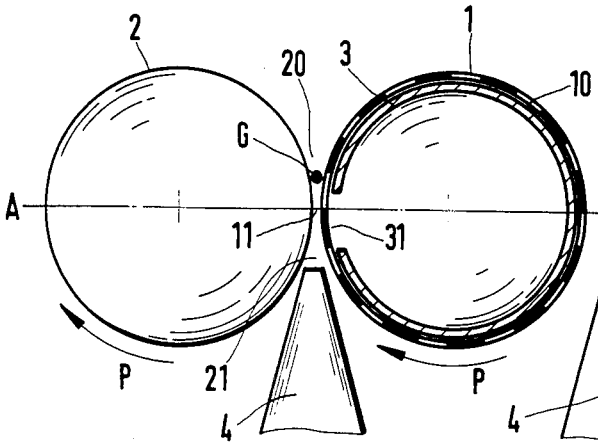
FIG. 1
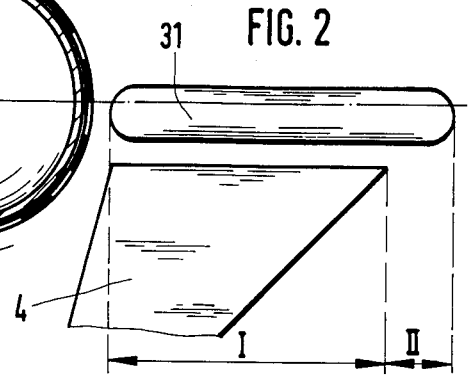
FIG. 2
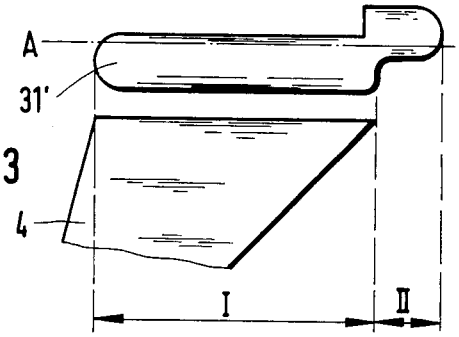
FIG. 3
FIG. 8
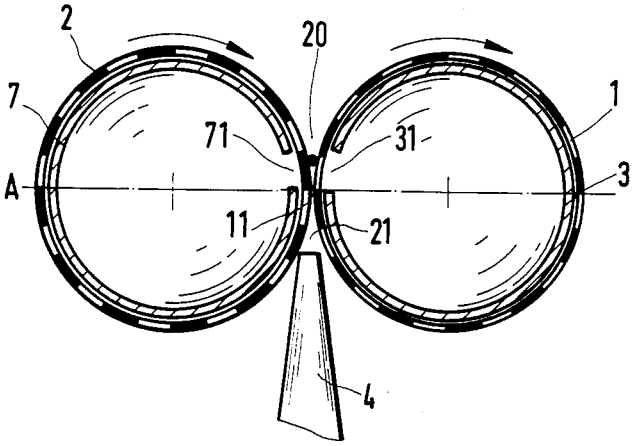

DUAL NIP OPEN-END FRICTION SPINNING

BACKGROUND OF THE INVENTION

This invention concerns in general open-end friction spinning, and in particular a method and apparatus for open-end friction spinning in which fibers are twisted together into a yarn in a spinning nip formed by two friction rollers located in close proximity of each other and driven in the same direction. The yarn is drawn off from the spinning nip generally in the direction of the rotational axes of the friction rollers.

In open-end friction spinning, fiber material is conventionally separated (i.e. opened) into individual fibers which are then brought into a spinning nip formed by two rotating friction rollers. The rollers are typically in close proximity of each other and driven in the same rotational direction. The individual fibers in the spinning nip are twisted together into a yarn by the rotation of the friction rollers. The yarn is drawn off in the direction of the spinning nip by means of a pair of draw-off rollers.

Known methods of feeding fibers for open-end friction spinning generally include feeding separated fibers directly into a spinning nip (e.g. German Pat. DE-PS No. 2,449,583, corresponding to U.S. Pat. No. 3,913,310), or feeding them at a distance from the spinning nip (on the yarn-forming side) to a friction roller which is embodied as a suction roller and which rotates into the spinning nip. The fibers are then conveyed into the spinning nip on the casing surface of the suction roller. This latter method is exemplified by German Pat. DE-OS No. 3,300,636. The quality of yarn thus produced is often considered unsatisfactory, because the individual fibers are not sufficiently stretched and oriented when they are incorporated into the body of fibers forming the yarn.

SUMMARY OF THE INVENTION

The present invention recognizes and addresses such drawbacks and disadvantages, as well as others. Numerous objects and features of this invention will become apparent from the following specification.

It is one objective of the present invention to improve the feeding of fibers into a spinning nip in such manner as will also improve the quality of the resultant yarn.

Further objects of the invention include improved stretching of individual fibers as they are being spun into yarn, and improved incorporation of such fibers into the body of yarn being produced.

One aspect of the instant invention concerns feeding fibers to a nip formed by the friction rollers on a side thereof opposite the spinning nip formed thereby. Such fibers are then conveyed from the feeding nip by passing between the two friction rollers and into the spinning nip.

In general, practice of this invention considerably improves the incorporation of fibers into the yarn end, which function is an important determinative in the quality of the yarn produced. Also, fibers are advantageously stretched as they are conveyed through the gap between the friction rollers due to a stretching effect caused by opposing tangential movement of the friction rollers at the gap therebetween. While being incorporated into the yarn end, the stretched fibers are drawn tight by a clamping effect upon the pursuing, free fiber end between the friction rollers. Uncontrolled feeding of fibers to the thread being formed is thus positively avoided.

Per a further aspect of this invention, fibers may either be fed directly into the feeding nip, or be fed upon the casing surface of a particular friction roller which is oriented and operated to rotate in the direction out of the feeding nip and into the spinning nip. Fibers are securely conveyed from the feeding nip into the spinning nip by providing greater force upon the fibers with a particular one of the friction rollers than with the other friction roller. Providing such force on (i.e. slaving of) the fibers is further facilitated by exposing the fibers to a suction air stream as soon as they reach the feeding nip.

Incorporation of fibers is yet further improved if such fibers are directed from the feeding nip into the spinning nip along a pathway which is inclined (i.e. at a predetermined angle) in relation to the draw-off direction of the yarn being produced.

Still another object of this invention concerns the prevention of fiber compressing up on the friction rollers. Such compressing of fibers as they are fed upon the casing surface of the friction roller is avoided in accordance with one aspect of this invention by feeding the fibers onto such casing surface at a tangent (i.e. an angle not perpendicular to the rotational axis of the roller).

One of the features presently disclosed concerns a device constructed in accordance with this invention, wherein the nip formed by the paired friction rollers on the opposite side of the spinning nip defines a feeding nip. Furthermore, the friction roller rotating out of the feeding nip and into the spinning nip defines a conveying roller for directing fiber material from the feeding nip to the spinning nip, the pathway for which includes passage between the two friction rollers.

Yet another optional feature of this invention is that the outlet of a fiber feeding channel may extend into the feeding nip. In such instance, it is generally preferable to position the fiber feeding channel in an inclined relationship to the yarn draw-off direction, so that fibers come at an angle into contact with the yarn end residing in the spinning nip.

In a further, alternative aspect of this invention, the outlet of the fiber feeding channel may instead be directed upon the casing surface of the friction roller which rotates out of the feeding nip and into the spinning nip (i.e. the defined conveying roller). Tangential feeding of the fibers onto the casing surface is possible because the fiber feeding channel is provided with a sidewall extending in the direction of the feeding nip, and because the fiber feeding channel wall across from such sidewall is constituted by the adjoining friction roller. Preferably, the fiber feeding channel is installed in an inclined position in relation to the casing surface of the friction roller, so that fibers fed thereto are oriented according to a preselected angle.

The greater fiber slaving force of the friction roller constituting the conveying roller (i.e. rotating out of the feeding nip and into the spinning nip) may be achieved in one exemplary manner through greater roughness for the casing surface of such conveying roller than that of the other friction roller. Preferably the casing surfaces of the two friction rollers are formed so that in a defined fiber feeding zone the casing surface of the friction roller constituting the conveying roller is of greater roughness than the other roller, and vice versa in a defined twisting zone. Such arrangement ensures that fibers are conveyed (and stretched) through the gap between the friction rollers and into the spinning nip. It also ensures that the yarn produced is held in sufficient torsion-imparting contact with the friction rollers, especially in the area of the spinning nip. The rougher casing surface of the friction rollers may be suitably produced by a variety of techniques, but diamond coating is one preferred way.

The fiber slaving force forming one feature of this invention may be further increased by configuring the friction roller constituting the conveying roller as a suction roller, whereby the middle of a suction slit thereof is positioned in the defined fiber feeding zone, peripherally on the suction roller at a distance on the side of the feeding nip from a plane in the axes of the friction rollers. Locating the middle of the suction slit on the side of the spinning nip in such position increases the forces in the twisting zone holding the yarn in the spinning nip. Fiber orientation favorable to their incorporation into the yarn being produced is also enhanced by aligning rows of perforations in the casing of such friction roller constituted as a suction roller in the direction of fiber feeding.

In a further feature ensuring retention of yarn in the twisting zone, the casing of the friction roller rotating out of the spinning nip and into the feeding nip is perforated in the twisting zone and provided with a suction insert having a suction slit, the length of which corresponds essentially to the length of the twisting zone and the middle of which is located at a distance from the axes-connecting plane (in a peripheral sense) on the side thereof nearer the spinning nip.

Experience has shown spinning results to be especially good if both friction rollers of the pair are embodied as suction rollers, with the suction slits disposed so that only the spinning nip is subjected to negative pressure (i.e. suction). Also, greater frictional contact between yarn and friction rollers results from a gradual reduction of the distance between the friction rollers, in the direction of yarn draw-off.

While a variety of objects and features are set forth by the invention, various collections of different features and aspects of this invention may be collected to comprise a given exemplary embodiment (either method or apparatus) thereof. For present purposes, several particular preferred examples of such embodiments are disclosed. For example, one such exemplary construction concerns an open-end friction spinning apparatus, comprising: friction roller means for defining a spinning nip adapted for spinning opened fibers directed thereto into yarn; fiber feeding channel means for feeding opened fibers to the proximity of the friction roller means; and conveying means for directing to the spinning nip the opened fibers fed by the channel means, whereby the fibers are stretched and held tightly for being spun into fibers.

Yet another exemplary embodiment of this invention includes a device for performing open-end friction spinning, including: two rotatable friction rollers in close proximity to each other with a gap therebetween, and drivable in the same direction; a fiber feeding channel for supplying fibers material to the rollers; and two nips formed on opposing sides of the gap, one of the nips constituting a spinning nip in which fiber material directed thereto is spun into yarn, and the other of the nips constituting a feeding nip which receives fibers material from the fiber feeding channel; wherein one of the friction rollers rotates away from the feeding nip and into the spinning nip so as to form a conveying roller for directing fiber material from the feeding nip to the spinning nip through the gap, whereby the fiber material is stretched as it is directed through the gap.

Still another exemplary embodiment constructed in accordance with features of this invention is directed to an apparatus for open-end friction spinning, including: two friction rollers in close proximity to each other and driven in the same direction; and two nips formed on opposite sides of the rollers, one of the nips constituting a spinning nip, and the other of the nips constituting a feeding nip; wherein one of the friction rollers rotates out of the feeding nip into the spinning nip and is provided with a closed casing having a surface of greater roughness than the casing surface of the other friction roller, which other roller rotates out of the spinning nip into the feeding nip, and which is embodied as a suction roller.

Yet another exemplary form of this invention concerning more particularly the method thereof is a process for performing open-end friction spinning in which fibers are twisted together into a yarn in a spinning nip formed by two friction rollers in close proximity of each other and driven in the same direction, such yarn being subsequently drawn off from the spinning nip in the direction of the rotational axes of the friction rollers, such process including: initially feeding fibers to a feeding nip formed on an opposite side of the friction rollers from the spinning nip formed thereby; and then feeding fibers from the feeding nip, between the two friction rollers, and into the spinning nip, whereby the fibers are desirably stretched for being spun into yarn.

Still another exemplary method embodiment in accordance with features of this invention includes a method of performing open-end friction spinning such that fibers are stretched and held tightly while being spun into yarn, such method comprising the steps of: providing two rotatable friction rollers in close proximity to each other with a gap therebetween and driven in the same direction, a plane being defined by the rotational axes of the rollers and passing through the smallest point of the gap, and a spinning nip in which fibers are spun into yarn being formed by the rollers adjacent the gap on one side of the plane; feeding fibers to a feeding nip formed by the rollers adjacent said gap on a side of the plane opposite the spinning nip; and conveying the fibers from the feeding nip to the spinning nip through the gap, wherein the fibers are stretched as they pass through the gap and held tightly for being spun into yarn in the spinning nip.

BRIEF DESCRIPTION OF THE DRAWINGS

A full and enabling disclosure of the present invention, including the best mode thereof, is set forth by this specification, including reference to the appended figures, in which:

FIG. 1 illustrates a cross-sectional view through the diameter of a pair of friction rollers, with one friction roller being subjected to suction air and with a fiber feeding channel directed into a feeding nip on an opposite side of the rollers from a spinning nip thereof;

FIG. 2 illustrates a side schematical view of a suction slit extending alongside a fiber feeding and twisting zone of the exemplary FIG. 1 friction roller which is subjected to suction;

FIG. 3 illustrates another embodiment of a suction slit, varying from that of FIG. 2, in accordance with features of this invention;

FIG. 8 shows in cross-section two friction rollers, both of which are embodied as suction rollers;

Figure 5:
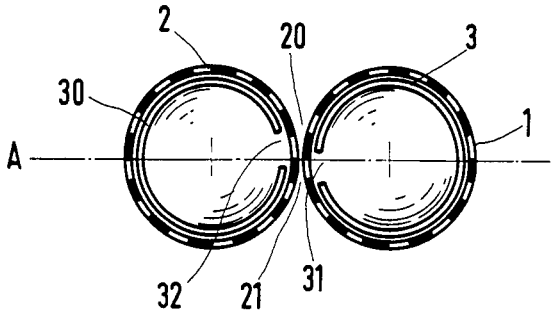
FIG. 5 is a cross-sectional view of the FIG. 4 pair of friction rollers taken along the line B—B indicated in FIG. 4.

Like use of reference characters throughout the specification and figures is intended to indicate same or analogous elements or features of this invention.

DETAILED DESCRIPTION OF THE PREFERRED EMBODIMENTS

Figure 4:
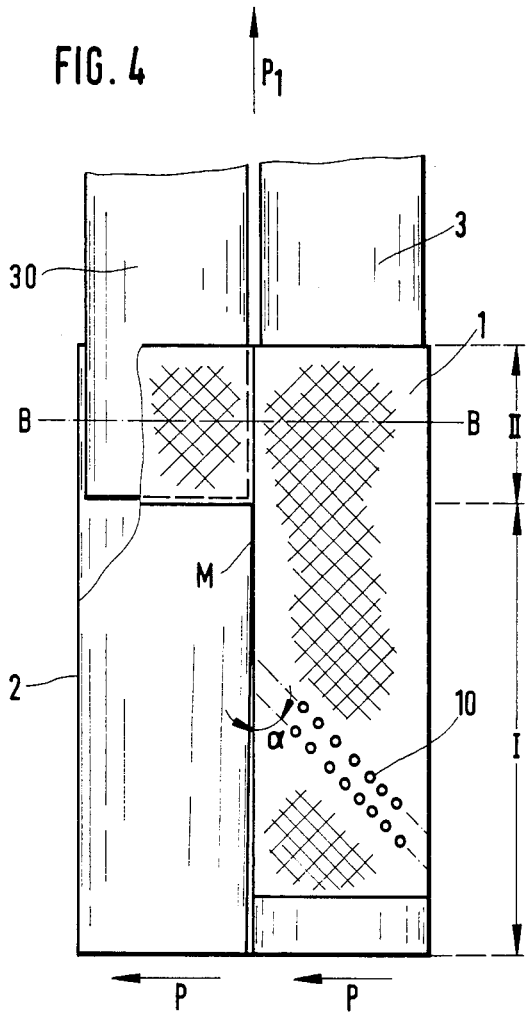
FIG. 4 shows a plan side view of a pair of friction rollers.

Referring to FIG. 1, a pair of friction rollers 1 and 2 are installed in close proximity to each other and driven in the same rotational direction, as indicated by arrows P. Rotation may be controllably effected by a variety of means such as a tangential belt (not shown). Friction rollers 1 and 2 form a small gap 11 in the area where they are closest to each other. Two nips 20 and 21 exist on opposing sides of gap 11. Fiber material previously opened (i.e. separated into individual fibers) is twisted together into a yarn G in nip 20, which is thus designated a spinning nip. Yarn G is drawn off from spinning nip 20 in yarn draw-off direction $P_1$, as illustrated by FIG. 4. Fibers are initially fed into nip 21, on the opposite side of gap 11 from spinning nip 20, which is therefore designated as a feeding nip.

In the exemplary embodiment of FIG. 1, the friction roller rotating out of spinning nip 20 and into feeding nip 21 (i.e. roller 2) has a closed casing, while friction roller 1 (rotating out of feeding nip 21 and into spinning nip 20) is embodied as a suction roller. The casing of roller 1 therefore is provided with perforations 10, and has a tubular suction insert 3 positioned within such casing.

Insert 3 is provided with a suction slit 31 and connected to a source of negative air pressure (i.e. a vacuum source, not shown). Suction slit 31 extends in the longitudinal direction of spinning nip 20 over a defined fiber feeding zone I and a suctionally downstream area, twisting zone II, both of which are shown in FIG. 2. In the embodiment of FIGS. 1 and 2, slit 31 is eccentric in relation to a plane A defined by the axes of the two friction rollers 1 and 2 (illustrated by a number of the figures), and disposed so that the middle thereof is located on the side of plane A closer to feeding nip 21 (as illustrated in FIG. 1).

The length of fiber feeding zone I is determined (as illustrated by FIGS. 2 and 3) by the length of a discharge opening of fiber feeding channel 4. Channel 4 is located on the side of friction rollers 1 and 2 away from spinning nip 20, with its discharge opening (i.e. outlet) extending into feeding nip 21. In other words, the outlet channel 4 is provided on the side of gap 11 and plane A which is nearer feeding nip 21. Fiber feeding channel 4 is preferably inclined in relation to the direction of yarn draw-off $P_1$, which is generally parallel to the rotational axes of rollers 1 and 2. Channel 4 can however be positioned perpendicular to such direction of yarn draw-off. An opening cylinder 5 illustrated (only for the embodiment of present FIG. 6) is connected to the fiber feeding channel 4, and has fiber material to be opened into individual fibers fed thereto by means of a feeding trough 51 and a feeding roller 52.

Friction roller 1, designated in the FIG. 1 embodiment as the conveying roller for rotating out of feeding nip 21 and into spinning nip 20, has greater fiber slaving force than friction roller 2. In other words, fibers received in feeding nip 21 are influenced more by conveying roller 1 than friction roller 2, whereby such fibers are directed through gap 11 into spinning nip 20. Such so-called slaving force is created preferably by providing the casing surface of friction roller 1 with greater roughness than that of friction roller 2, suitably by various means such as a diamond coating. Other methods, for example exclusively using pneumatic means, are however optional features of this invention which may be practiced to provide greater slaving force with a given conveying roller.

Such fiber slaving force effected by friction roller 1 may be further increased if suction slit 31 is configured as shown in FIG. 2, because the suction effect thereof is thus concentrated on friction roller 1 upon the area of feeding nip 21. This construction for suction slit 31 furthermore produces a sufficiently powerful stream of conveying air within fiber feeding channel 4 in the direction of feeding nip 21 to convey opened fiber material into such feeding nip. There, fibers are seized by friction roller 1 and fed through narrow gap 11 into spinning nip 20, where they come into contact with the free yarn end at an angle because of the inclined position of fiber feeding channel 4 in relation to the direction $P_1$ of yarn draw-off.

As fibers pass through gap 11, they are oriented and stretched by the opposing peripheral movement of friction rollers 1 and 2 in the zone of gap 11. The forward rushing ends of fibers reach the free, rotating yarn end while the other fiber end is still held between friction rollers 1 and 2. The fibers are thus drawn tight as they are continuously incorporated into yarn, so that good joining is achieved.

If friction roller 1 (embodied as a conveying roller in FIG. 1) is provided with a rougher casing surface than friction roller 2 in the axial length thereof corresponding to defined twisting zone II, there is a danger that the yarn may at least in part lose contact with friction rollers 1 and 2 thereby being insufficiently twisted. This can be prevented, however, in accordance with further features of the present invention by perforating the casing of friction roller 2 in the area of twisting zone II, and by providing it with a suction insert 30 connectable to a suction device, as illustrated in FIG. 4.

Suction insert 30 has a suction slit 32, whose length corresponds essentially to the length of twisting zone II. Further, slit 32 is located in such manner that (when viewed in a peripheral direction) its middle is located on the side of axial plane A nearer spinning nip 20, and at a given distance from such plane A. FIG. 5 illustrates such relationship in particular. With such an arrangement, yarn is held in frictional contact with rollers 1 and 2 by the suction air stream force if same is made stronger than the fiber slaving force of friction roller 1, discussed above.

In a simpler alternative (and preferred) embodiment of this invention, yarn is held in twisting zone II in spinning nip 20 if the casing surface of friction roller 2 is closed also (instead of perforated) in twisting zone II, and if roller 2 has a rougher finish than the casing surface of friction roller 1. In such instance, the fiber slaving force of friction roller 2 is greater than that of friction roller 1 in such twisting zone, thereby producing the desired effects discussed above.

As a further alternative beyond such construction, the casing of suction insert 3 (installed within the casing of friction roller 1) can be provided with a modified suction slit 31' having a particular predetermined shape, such as shown in FIG. 3. In such instance (viewing same in the peripheral direction), the middle of suction slit 31' in the fiber feeding zone is located at a distance from axial plane A and, on the side of plane A nearer feeding nip 21, as in the embodiment of FIG. 2. But such middle is on the side of plane A nearer spinning nip 20 in twisting zone II, due to the particular shape of modified suction slit 31'. Thus, yarn produced with such modified suction slit 31' is held even more securely, particularly in the radial sense in spinning nip 20.

Another aspect of this invention is directed to improving frictional contact between the yarn being produced and the friction rollers. As illustrated in FIG. 4, such frictional contact between the yarn and rollers may be improved by displacing very slightly the axes of friction rollers 1 and 2 from a precise parallel relationship, so that the distance between such axes decreases in the direction $P_1$ of yarn draw-off.

A further alternative feature of this invention concerns fiber feeding channel 4, which can also be installed along one side of one of the friction rollers 1 and 2 opposite to spinning nip 20. In such instance, the outlet of channel 4 may be directed upon the casing of friction roller 1 (which rotates out of feeding nip 21 and into spinning nip 20). As illustrated by the exemplary embodiment of FIGS. 6 and 7, in order to feed fibers in an optimal position to spinning nip 20 when such type of feeding is used, fiber channel 4 is inclined in relation to an illustrated casing line M of the friction roller 1 so that a defined middle line S of channel 4 forms an angle $\alpha$, obliquely to casing line M. In order to maintain fiber feed direction determined by fiber feeding channel 4, the rows of perforations 10 also form this angle x with respect to casing line M. While a variety of values for angle $\alpha$ may be practiced in accordance with this invention, an angle in the range of 40° to 60° is preferred for yielding good spinning results.

Figure 7:
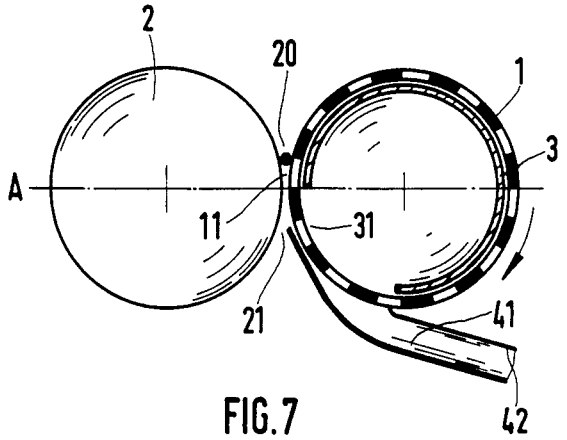
FIG. 7 illustrates in cross-section the pair of friction rollers and fiber feeding arrangement of FIG. 6.
Figure 6:
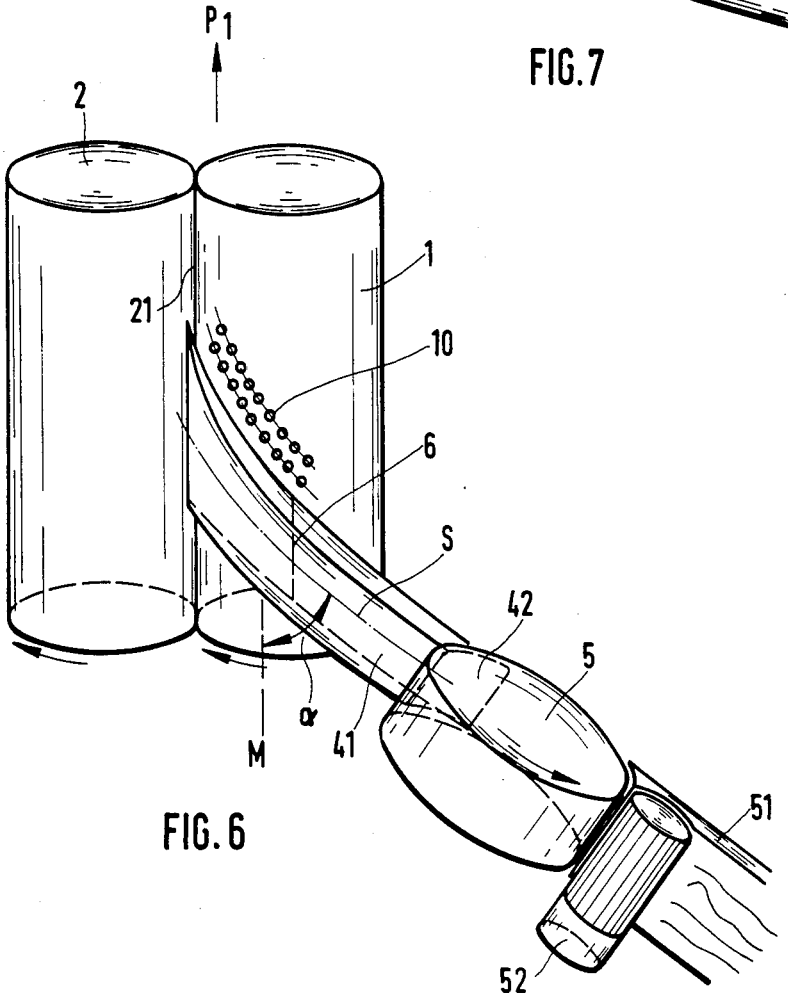
FIG. 6 shows in perspective a pair of friction rollers and a fiber feeding arrangement having a fiber feeding channel directed onto the casing surface of one of the friction rollers subjected to suction.

The fiber feeding channel 4 of FIGS. 6 and 7 is further configured so that a sidewall 41 thereof extends in the direction of and all the way into feeding nip 21, and is suitably adapted to be operatively associated with the curvature of friction roller 1. Particularly as illustrated by present FIG. 7, sidewall 42 of channel 4 which (is across from sidewall 41 thereof) terminates against a defined contact line 6 of friction roller 1. Hence, only sidewall 41 of fiber feeding channel 4 extends from contact line 6 onward to gap 11, while thereafter the casing surface of friction roller 1 replaces sidewall 42 to oppose sidewall 41 and define channel 4.

In the embodiment of FIGS. 6 and 7, the middle of suction slit 31 is again located on a side of plane A nearer feeding nip 21, at a given distance from plane A (which connects the friction roller axes) about the periphery of roller 1 (See FIG. 7). However, in this instance suction slit 31 extends up to contact line 6 defined by the termination of sidewall 42 of fiber feeding channel 4 adjacent friction roller 1. On the side of plane A nearer spinning nip 20, suction slit 31 can be alternatively configured as in the embodiments of either FIGS. 2 or 3.

In either instance, fibers separated by opening cylinder 5 are fed tangentially (and without fiber compressing) in a particular position upon casing line M (and inclined in relation thereto), and are fed in such position by friction roller 1 through gap 11 into spinning nip 20, due to the greater slaving force of friction roller 1 compared with friction roller 2. Upon passing through gap 11, the fibers are desirably stretched and held tight by the clamping of the pursuing fiber end in gap 11 during incorporation into a yarn end in spinning nip 20.

In a further alternative, exemplary embodiment shown in FIG. 8, both friction rollers 1 and 2 are perforated and equipped with suction inserts 3 and 7, respectively, whose suction slits 31 and 71 are extended along the aforementioned fiber feeding zone and twisting zone. Such configuration yields especially good spinning results if the fiber material is fed directly into feeding nip 21, and if suction effect is limited to the side of plane A nearer spinning nip 20. For such purpose, suction slits 31 and 71 are peripherally located on their respective rollers on the side of plane A nearer spinning nip 20. Generally as before, fibers fed directly into feeding nip 21 by means of fiber feeding channel 4 are directed by friction roller 1 through gap 11 directly into feeding nip 21, during which they are stretched and are held tight during their incorporation into the yarn end. It is however also possible to feed the fibers over and beyond plane A upon the casing surface of friction roller 1, if suction slit 31 is accordingly widened.

Figure 9:
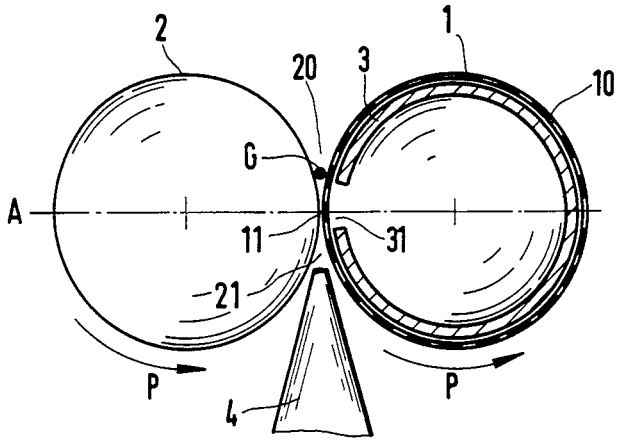
FIG. 9 illustrates in cross-section a pair of friction rollers with one friction roller embodied as a conveying roller (i.e. rotating out of the feeding nip and into the spinning nip) and having a closed casing, and the other friction roller embodied as a suction roller and rotating out of the spinning nip into the feeding nip.
Figure 10:
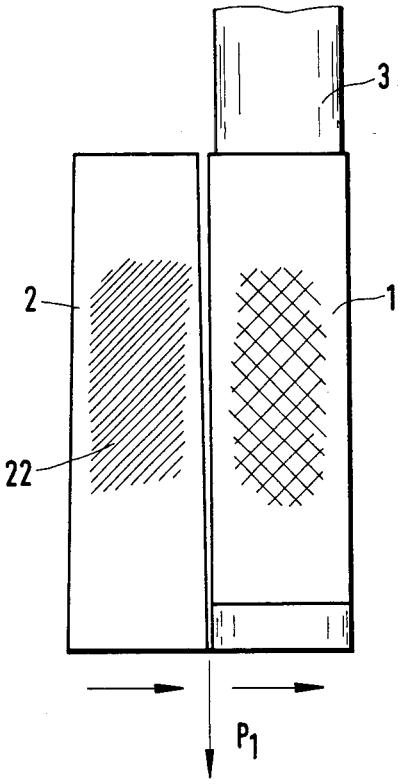
FIG. 10 shows a side plan view of the pair of friction rollers of FIG. 9.
Figure 11:
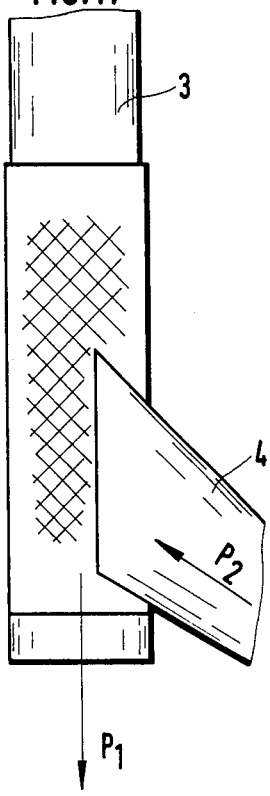
FIG. 11 shows a vertical cross-section in the vertical plane of the narrowest part of the gap between the pair of exemplary friction rollers, illustrated particularly in FIGS. 9 and 10, in accordance with this invention.

FIGS. 9 through 11 illustrate another preferred exemplary embodiment of a spinning device constructed and operated in accordance with features of this invention. In one instance, such embodiment differs from that shown in FIG. 1 in that friction roller 2, (with a closed sleeve) rotates out of feeding nip 21 and into spinning nip 20 so as to constitute a conveying roller for feeding fibers from feeding nip 21 through gap 11 into spinning nip 20. Such rotation is reversed from that of the FIG. 1 embodiment.

In FIG. 9, friction roller 1 is provided as a suction roller, and rotates out of spinning nip 20 into feeding nip 21, also reverse to that of FIG. 1. Fiber material opened into individual fibers is similar to the embodiment of FIG. 1 fed directly through the fiber feeding channel 4 into feeding nip 21. Fiber feeding channel 4 is inclined ($P_2$) in relation to the direction of yarn draw-off ($P_1$), as particularly illustrated by FIG. 11.

Friction roller 2 is provided with a greater fiber slaving force than friction roller 1 by means of helicoidal-shaped ribbing 22 formed on roller 2 (as shown by FIG. 10). Such greater force may be enhanced by means of a coating, for example a diamond coating. In order to achieve good stretching and parallel orientation of fibers as they are fed through gap 11 between the friction rollers 1 and 2, friction roller 1 may also be diamond coated. However, in such instance it is preferred a grain size be selected for the coating of roller 1 which is at least 2μ smaller than the grain size selected for the coating of friction roller 2. While variations may be practiced it is preferred that grain sizes of 6μ for friction roller 2 and of 4μ for friction roller 1 not be exceeded. A diamond coating with a grain size of 4μ for friction roller 2 and with a grain size of 2μ for friction roller 1 is especially preferred.

Suction slit 31 of suction insert 3, installed in friction roller 1 which is embodied as a suction roller, and which extends from the fiber feeding zone up to the twisting zone, is preferably about 8 mm wide in a peripheral direction. Suction slit 31 may extend in the direction of spinning nip 20 in the range of 3 to 5 mm beyond designated plane A, as represented by the illustration of FIG. 9. In such manner, yarn is maintained in frictional contact with friction rollers 1 and 2 through the suction air stream force existent in the area of spinning nip 20 on one hand. On the other hand in fiber feeding channel 4, a conveying air produced by such configuration in dynamic, operative association with suction applied thereto sufficient for the feeding of fibers into feeding nip 21. Additional pneumatic means for fiber feeding are therefore not needed.

In the embodiment of FIGS. 9–11, (and particularly as illustrated by FIG. 10) the distance between friction rollers 1 and 2 in spinning nip 20 also decreases in the yarn draw-off direction $P_1$ (as represented by FIGS. 10 and 11), to thereby improve the frictional contact between yarn being produced and rollers 1 and 2 in such spinning nip. However, such decrease does not result by displacing friction rollers 1 and 2 from their axially parallel positions (as is illustrated in the embodiment of FIG. 4), but instead by providing a selected one of the two friction rollers (preferably friction roller 2 having a closed casing) with a conical configuration.

In this latter embodiment, spinning is also executed generally in the manner previously described, whereby yarn being produced is drawn off from spinning nip 20 in a direction $P_1$ contrary to the feeding direction $P_2$ illustrated by FIG. 11. Thus, the fibers change direction after their forward-rushing free end is incorporated into the yarn end. Such directional change from $P_2$ to $P_1$, facilitated by helicoidal-shaped ribbing 22 of friction roller 2, has a desirable effect on the spinning results (i.e. the resulting yarn). Helicoidal ribbing 22 furthermore promotes a self-cleaning function for roller 2 by preventing the adherence of fibers of the diamond coated casing surface of same.

While particular exemplary preferred embodiments of the present method and apparatus have been disclosed, various modifications to elements, features, and steps of this invention (as well as equivalent substitutions and expedient reversals) will occur to those of ordinary skill in the art. All such alterations to either the present method or apparatus are intended to come within the scope and spirit of this invention. Furthermore, while various exemplary embodiments have been disclosed and described in detail, all language concerning same is intended as words of description and example only, and not words of limitation which are found only in the appended claims.

What is claimed is:

1. An open-end friction spinning apparatus, comprising:

friction roller means, comprising a pair of friction rollers being rotatable in the same direction, and disposed adjacent one another so as to define a relatively small gap therebetween, and defining a spinning nip on one side of said gap adapted for spinning opened fibers directed thereto into yarn, and further defining a feeding nip on the other side of said gap;

fiber feeding channel means for feeding opened fibers to the proximity of said friction roller means into said feeding nip thereof; and conveying means for directing to said spinning nip said opened fibers fed by said channel means, whereby said fibers are stretched and held tightly for being spum into fibers, wherein said conveying means includes means for providing the friction roller rotating out of said feeding nip and into said spinning nip with a greater fiber slaving force than the other friction roller so as to carry said fibers from said feeding nip to said spinning nip through said gap between said friction rollers.

2. An apparatus as in claim 1, wherein:

said friction roller means comprises a pair of friction rollers being rotatable in the same direction, and disposed adjacent one another so as to define a relatively small gap therebetween, with said spinning nip formed on one side of said gap, and a feeding nip formed on the other side of said gap;

said channel means feeds said fibers to said feeding nip; and said conveying means directs said fibers from said feeding nip to said spinning nip through said gap defined between said friction rollers.

3. An apparatus as in claim 1, wherein said friction roller means comprise two friction rollers mounted with their rotational axes substantially in parallel, with one of said rollers comprising a suction roller having perforations in the periphery thereof, and a suction insert with a longitudinal suction slit included therein.

4. An apparatus as in claim 3, wherein said suction slit extends over a fiber feeding zone defined by an opening of said fiber feeding channel means, the remainder of said suction slit not so extending defining a twisting zone.

5. An apparatus as in claim 4, wherein:

the rotational axes of said friction rollers defines a plane; and in both said fiber feeding zone and said twisting zone, the middle of said suction slit is formed on the side of said plane closer to said feeding nip.

6. An apparatus as in claim 4, wherein;

said rotational axes of said friction rollers define a plane; and further wherein:

in said fiber feeding zone, the middle of said suction slit is substantially on the side of said plane closer to said feeding nip; and in said twisting zone, the middle of said suction slit is substantially on the side of said plane closer to said spinning nip.

7. An apparatus as in claim 3, wherein said friction rollers are slightly displaced from a precisely parallel relationship with one another such that a gap defined therebetween decreases in a defined yarn draw-off direction of said apparatus, whereby frictional contact between yarn being produced and said friction rollers is desirably increased.

8. An apparatus as in claim 3, wherein one of said friction rollers is formed slightly conical so that a gap defined between said friction rollers decreases in a defined yarn draw-off direction of said apparatus, whereby frictional contact between yarn being produced and said friction rollers is desirably increased.

9. An apparatus as in claim 2, wherein said channel means is disposed at a given angle $\alpha$ relative a defined yarn draw-off direction of said apparatus, whereby said fibers are fed to said spinning nip in an optimal position.

10. An open-end friction spinning apparatus, comprising:

friction roller means for defining a spinning nip adapted for spinning opened fibers directed thereto into yarn;

fiber feeding channel means for feeding opened fibers to the proximity of said friction roller means; and conveying means for directing to said spinning nip said opened fibers fed by said channel means, whereby said fibers are stretched and held tightly for being spun into fibers; wherein said friction roller means comprises a pair of friction rollers being rotatable in the same direction, and disposed adjacent one another so as to define a relatively small gap therebetween, with said spinning nip formed on one side of said gap, and feeding nip formed on the other side of said gap;

said channel means feeds said fibers to said feeding nip;

said conveying means directs said fibers from said feeding nip to said spinning nip through said gap defined between said friction rollers;

said channel means is disposed at a given angle $\alpha$ relative a defined yarn draw-off direction of said apparatus, whereby said fibers are fed to said spinning nip in an optimal position;

said angle $\alpha$ preferably falls in a range of 40° to 60°; and further wherein one of said friction rollers is embodied as a suction roller with perforations formed in the periphery thereof, rows of said perforations being aligned in said angle $\alpha$ to maintain the feeding direction of fibers through fiber feeding channel means.

11. An apparatus as in claim 2, wherein both of said friction rollers are embodied as suction rollers with perforations in the periphery thereof, and a suction insert with longitudinal suction slit received therein with suction applied thereto during spinning operations.

12. An open-end friction spinning apparatus, comprising:

friction roller means for defining a spinning nip adapted for spinning opened fibers directed thereto into yarn;

fiber feeding channel means for feeding opened fibers to the proximity of said friction roller means; and conveying means for directing to said spinning nip said opened fibers fed by said channel means, whereby said fibers are stretched and held tightly for being spun into fibers; wherein said friction roller means comprises a pair of friction rollers being rotatable in the same direction, and disposed adjacent one another so as to define a relatively small gap therebetween, with said spinning nip formed on one side of said gap, and a feeding nip formed on the other side of said gap;

said channel means feeds said fibers to said feeding nip;

said conveying means directs said fibers from said feeding nip to said spinning nip through said gap defined between said friction rollers;

both of said friction rollers are embodied as suction rollers with perforations in the periphery thereof, and a suction insert with longitudinally suction slit received therein with suction applied thereto during spinning operations;

the rotational axes of said suction rollers define a plane; and further wherein the middle of the suction slit of one of said suction rollers is substantially disposed on one side of said plane, and the middle of the suction slit of the other of said suction rollers is disposed substantially on an opposite side of said plane from said one side thereof.

13. An apparatus as in claim 11, wherein:

the rotational axes of said suction rollers define a plane; and further wherein:

the middle of the suction slits of both of said suction rollers are substantially disposed on the side of said plane nearer said spinning nip.

14. An apparatus as in claim 2, wherein:

one of said friction rollers comprises a suction roller having a plurality of perforation in the periphery thereof, and a suction insert with longitudinal suction slit received therein; and the other of said friction rollers is provided with a solid tubular casing; and further wherein said suction roller further constitutes a conveying roller for being rotatably driven in a direction out of said feeding nip and into said spinning nip so as to direct fibers from said feeding nip to said spinning nip through said gap between said friction rollers.

15. An apparatus as in claim 2, wherein:

one of said friction rollers comprises a suction roller having a plurality of perforations in the periphery thereof, and a suction insert with longitudinal suction slit received therein; and the other of said friction rollers is provided with a solid tubular casing; and further wherein the other of said friction rollers further constitutes a conveying roller rotatably driven in a direction from said feeding nip to said spinning nip so as to direct fibers from said feeding nip to said spinning nip through said gap between said friction rollers.

16. A device for performing open-end friction spinning, including:

two rotatable friction rollers in close proximity to each other with a gap therebetween, and drivable in the same direction;

a fiber feeding channel for supplying fiber material to said rollers; and two nips formed on opposing sides of said gap, one of said nips constituting a spinning nip in which fiber material directed thereto is spun into yarn, and the other of said nips constituting a feeding nip which receives fiber material from said fiber feeding channel;

wherein one of said friction rollers rotates away from said feeding nip and into said spinning nip and has a greater fiber slaving force than the other roller so as to form a conveying roller for directing fiber material from said feeding nip to said spinning nip through said gap, whereby said fiber material is stretched as it is directed through said gap.

17. A device as in claim 16, wherein an outlet of said fiber feeding channel extends into said feeding nip.

18. A device as in claim 16, wherein said fiber feeding channel is inclined towards said friction rollers at a predetermined angle in relation to the direction of yarn draw-off of said device.

19. A device as in claim 16, wherein an outlet of said fiber feeding channel is directed against the casing surface of said friction roller which forms said conveying roller.

20. A device as in claim 19, wherein said fiber feeding channel has one sidewall disposed generally along said casing surface of said conveying roller and extending essentially to said feeding nip, and another sidewall which terminates at a contact line thereof with said casing surface, wherein said casing surface opposes said one sidewall thereafter so as to function as said another sidewall of said channel, down to said feeding nip.

21. A device as in claim 16, wherein the casing surface of said friction roller forming said conveying roller is rougher than the casing surface of the other friction roller, to thereby impart greater force to said fiber materials for directing same through said gap and towards said spinning nip.

22. A device as in claim 16, further comprising:

a fiber feeding zone defined by an outlet of said fiber feeding channel, and a twisting zone for twisting of fiber materials; and wherein in said fiber feeding zone, the casing surface of said conveying roller is rougher than that of the other frictional roller, and vice versa in said twisting zone.

23. A device as in claim 21, wherein said rougher casing surface is produced by means of a diamond coating.

24. A device as in claim 22, wherein said rougher casing surface is produced by means of a diamond coating.

25. A device as in claim 16, wherein:

said friction roller constituting said conveying roller is also embodied as a suction roller having perforations on the periphery thereof, and a suction insert with longitudinal suction slit received therein; and wherein the middle of said suction slit is located in a fiber feeding zone, defined by association of an outlet of said fiber feeding channel with said slit, and removed in a peripheral direction from a plane defined by the rotational axes of said friction rollers and disposed on a side of said plane nearer said feeding nip.

26. A device as in claim 25, wherein:

a remainder of said suction slit not associated with said fiber feeding channel outlet defines a twisting zone; and wherein the middle of said suction slit in said twisting zone is located on a side of said plane nearer said spinning nip.

27. A device as in claim 25, wherein said perforations are formed in rows aligned in a direction of fiber feeding determined by said fiber feeding channel.

28. A device as in claim 25, wherein:

a remainder of said suction slit of said conveying roller not associated with said fiber feeding channel defines a twisting zone; and wherein the other friction roller not constituting said conveying roller also is embodied as a suction roller, having perforations in the periphery thereof in said twisting zone, and being provided with a suction insert therein with a longitudinal suction slit, the length of said slit corresponding essentially to the length of said twisting zone therefor and the middle of which is located in a peripheral sense a distance from said plane on the side thereof nearer said spinning nip.

29. A device as in claim 16, wherein both of said friction rollers comprise suction rollers having peripheral perforations, and internally received suction inserts with suction slits, said suction slits being generally disposed in the direction of said spinning nip so that said feeding nip is not subjected to negative air pressure during spinning operations.

30. A device as in claim 16, wherein said gap between said friction rollers decreases in the yarn draw-off direction of said device, so as to increase frictional contact between yarn being produced and said friction rollers.

31. A device as in claim 16, wherein at least one of said friction rollers is embodied as a suction roller having peripheral perforations, and a suction insert included therein having a longitudinal suction slit, said suction slit extending, in a peripheral sense in the direction of said spinning nip, away from a plane defined by the rotational axes of said friction rollers.

32. An apparatus for open-end friction spinning, including:

two friction rollers in close proximity to each other and driven in the same direction; and two nips formed on opposite sides of said rollers, one of said nips constituting a spinning nip, and the other of said nips constituting a feeding nip; wherein one of said friction rollers rotates out of said feeding nip into said spinning nip, and is provided with a closed casing having a surface of greater roughness than the casing surface of the other friction roller, which other roller rotates out of said spinning nip into said feeding nip, and which is embodied as a suction roller.

33. An apparatus as in claim 32, wherein said rougher casing surface of said closed casing includes helicoidal-shaped ribbing and a diamond coating thereon.

34. An apparatus as in claim 33, wherein the casing surface of said friction roller embodied as a suction roller is provided with a diamond coating having a grain size preferably at least 2$\mu$ smaller than the grain size of said diamond coating on the friction roller with said closed casing.

35. An apparatus as in claim 34, wherein said grain size for the friction roller with said closed casing preferably does not exceed 6$\mu$, and the grain size for the friction roller embodied as a suction roller preferably does not exceed 4$\mu$.

36. An apparatus as in claim 32, wherein said friction roller embodied as a suction roller includes a suction insert received therein and having a longitudinal suction slit in said suction insert, said suction slit having a width of 8 mm in a peripheral sense and extending preferably in a range of 3 to 5 mm in the direction of said spinning nip beyond a plane defined by the rotational axes of said friction rollers.

37. An apparatus as in claim 32, wherein the rotational axes of said friction rollers are substantially in parallel, and one of said friction rollers is slightly conical, so that the distance between said friction rollers decreases in a yarn draw-off direction of said apparatus, thereby increasing frictional contact between yarn being produced and said frictional rollers.

38. An apparatus as in claim 32, wherein a yarn draw-off direction of said apparatus is established at a predetermined angle, preferably in the range of 40°–60°, with respect to the direction in which fibers are fed into said feeding nip.

39. A process for performing open-end friction spinning in which fibers are twisted together into a yarn in a spinning nip formed by two friction rollers in close proximity of each other and driven in the same direction, such yarn being subsequently drawn off from the spinning nip in the direction of the rotational axes of the friction rollers, said process including:

initially feeding fibers to a feeding nip formed on an opposite side of the friction rollers from the spinning nip formed thereby; and then feeding fibers from the feeding nip, between the two friction rollers, and into the spinning nip, whereby the fibers are desirably stretched for being spun into yarn;

wherein one of the friction rollers is embodied so as to exert greater slaving force upon fibers than the other friction roller, thereby permitting fibers to be directed between the rollers into the spinning nip.

40. A process as in claim 39, wherein the fibers are fed directly into the feeding nip.

41. A process as in claim 39, wherein feeding fibers to the feeding nip includes feeding the fibers onto the casing surface of a friction roller rotating away from the feeding nip and towards the spinning nip, whereby fibers are first directed to the feeding nip and then inbetween the rollers so as to reach the spinning nip.

42. A process as in claim 39, further including exposing the fibers to a suction air stream as soon as they reach the feeding nip.

43. A process as in claim 39, wherein the fibers are directed from the feeding nip into the spinning nip in a direction inclined with respect to a yarn draw-off direction, which draw-off direction is defined substantially in parallel with the rotational axes of the friction rollers.

44. A process as in claim 41, wherein the fibers are fed tangentially upon the casing surface of the friction roller.

45. A method of performing open-end friction spinning such that fibers are stretched and held tightly while being spun into yarn, said method comprising the steps of:

providing two rotatable friction rollers in close proximity to each other with a gap therebetween and driven in the same direction, a plane being defined by the rotational axes of said rollers and passing through the smallest point of said gap, and a spinning nip in which fibers are spun into yarn being formed by said rollers adjacent said gap on one side of said plane;

feeding fibers to a feeding nip formed by said rollers adjacent said gap on a side of said plane opposite said spinning nip; and conveying said fibers from said feeding nip to said spinning nip through said gap, by one of said friction rollers provided with a greater slaving force, wherein said fibers are stretched as they pass through said gap and held tightly for being spun into yarn in said spinning nip.

46. A method as in claim 45, further comprising the step of drawing off from said spinning nip yarn being spun therein, said drawing off being conducted in a direction contrary to the feeding direction of fibers.

47. An open-end friction spinning apparatus, comprising:

friction roller means for defining a spinning nip adapted for spinning opened fibers directed thereto into yarn;

fiber feeding channel means for feeding opened fibers to the proximity of said friction roller means; and conveying means for directing to said spinning nip said opened fibers fed by said channel means, whereby said fibers are stretched and held tightly for being spun into fibers; wherein said friction roller means comprises two friction rollers mounted with their rotational axes substantially in parallel, with one of said rollers comprising a suction roller having perforations in the periphery thereof, and a suction insert with a longitudinal suction slit included therein, said two friction rollers being displaced from one another such that a gap defined therebetween decreases in a defined yarn draw-off direction of said apparatus, whereby frictional contact between yarn being produced and said friction rollers is desirably increased.

* * * * *